United States Patent [19]

Gambertoglio

[11] Patent Number: 4,616,718

[45] Date of Patent: Oct. 14, 1986

[54] FIRING HEAD FOR A TUBING CONVEYED PERFORATING GUN

[75] Inventor: Louis M. Gambertoglio, The Woodlands, Tex.

[73] Assignee: Hughes Tool Company, Houston, Tex.

[21] Appl. No.: 762,171

[22] Filed: Aug. 5, 1985

[51] Int. Cl.[4] ..... E21B 43/17

[52] U.S. Cl. ..... 175/4.54; 175/4.56; 166/297; 166/55.1

[58] Field of Search ..... 175/4.52, 4.54, 4.56, 175/4.58, 4.59; 166/55.1, 297

[56] References Cited

U.S. PATENT DOCUMENTS

| | | | |
|---|---|---|---|
| 2,876,701 | 3/1959 | Long | 89/1 C |
| 3,189,094 | 6/1965 | Hyde | 166/55.1 |
| 3,800,705 | 4/1974 | Tamplen | 175/4.54 |
| 4,484,632 | 11/1984 | Vann | 175/4.54 |
| 4,531,590 | 7/1985 | Peterson | 175/4.56 |
| 4,554,981 | 11/1985 | Davies | 175/4.54 |

*Primary Examiner*—Stephen J. Novosad
*Assistant Examiner*—Terry Lee Melius
*Attorney, Agent, or Firm*—Charles D. Gunter, Jr.

[57] ABSTRACT

A firing head for a tubing conveyed perforating gun is shown which is operated by pressuring the interior of the tubing string. A sliding sleeve having a pressure responsive seal area changes position at a predetermined increase in tubing pressure. As the sleeve changes position, the production ports of the tool are first opened, allowing communication between the well annulus and the tubing interior. Movement of the sliding sleeve also drains an initially filled, hydraulic cylinder within the interior of the tool. As the cylinder is drained, an associated fluid piston moves to occupy the evacuated chamber. The fluid piston is connected to a firing pin holder which releases the firing pin, allowing the firing pin to contact a percussion detonator to fire the perforating gun.

12 Claims, 8 Drawing Figures

FIRING HEAD FOR A TUBING CONVEYED PERFORATING GUN

BACKGROUND OF THE INVENTION

The present application is related to the co-pending application of David L. Davies, entitled "TUBING PRESSURIZED FIRING APPARATUS FOR A TUBING CONVEYED PERFORATING GUN", Ser. No. 518,910 Filed Aug. 1, 1983, and assigned to the assignee of the present invention.

1. Field of the Invention

The present invention relates generally to firing devices of the type used to fire perforating guns used to perforate a cased well bore for the production of well bore fluids and, specifically, to a tubing pressurized firing device for firing a tubing conveyed perforating gun responsive to changes in the fluid pressure within the well bore tubing string.

2. Description of the Prior Art

The integrity of oil well and gas well bores is generally preserved during drilling operations by cementing a casing or liner in place in the bore hole. The casing or liner is a cylindrical conduit which must be punctured or perforated over the desired production interval in order to produce well bore fluids. Various types of perforating guns are known which utilize some form of a fired projectile and an explosive charge to perforate the casing or liner. Prior perforating gun techniques have either utilized tools which were run on a wireline or cable or were tubing conveyed devices which were run on a tubing string to the desired depth in the well bore.

Several problems exist with wireline run perforating gun systems. Wireline methods require a delicate balance between expected formation pressure and the drilling mud or fluid used to provide a balanced hydrostatic head in the well bore. A miscalculation of the expected formation pressure can result in a tangled wireline. If an over balanced pressure condition exists during the perforation step, the well can loose large volumes of fluid into the surrounding formation which can damage the formation. Also, proper pressure differentials are needed to effectively clean the perforations. It is difficult with the wireline system to obtain the pressure differential needed to back surge the perforations and provide a clean well which will produce high yields. It is also difficult to use wireline systems in deviated well bores.

The tubing conveyed perforating gun generally allows immediate safe release of formation pressure at maximum pressure differentials into the tubing string. The back surge which results tends to clean the perforation of mud filtrate, cement, and other perforating debris. In spite of these advantages, prior tubing conveyed perforating guns have lacked the ideal detonating system. Prior systems were usually detonated by (1) a bar dropped through the tubing string to fire a percussion detonator; (2) a through-the-tubing wireline connection system using an electrical charge to detonate the gun; or (3) well annulus pressurized systems which were actuated by fluid pressure acting through ports in the tubing string located above the packer. The first two systems require a wireline run in order to set a hydraulic packer to seal off the well bore. The third system above could only be used with a mechanically set well packer or a previously set permanent packer. Also, there was no satisfactory delay mechanism for the detonator of the gun.

It is an object of the present invention to provide a tubing conveyed perforating gun which is actuated by pressuring the tubing interior from the well surface.

Another object of the invention is to provide a tubing conveyed perforating gun which can be utilized with a hydraulically set packer where the packer is set by pressuring the tubing to a first predetermined level and where the perforating gun is actuated by pressuring the tubing to a second predetermined level.

Another object of the invention is to provide a tubing conveyed perforating gun with a delay mechanism which provides a known delay interval between pressuring the tubing to the second predetermined level and the actual firing of the perforating gun.

SUMMARY OF THE INVENTION

Present invention is a firing head for use with a tubing conveyed perforating gun of the type which uses a firing pin to strike an explosive charge to perforate a well bore for production of well bore fluids. The firing head includes a tubular sub having an interior bore and oppositely disposed connecting ends for connection in a well pipe string. A firing pin is contained within the interior bore and is initially restrained in a cocked position by a firing pin holder. Biasing means are provided for propelling the firing pin toward the explosive charge upon the release of the firing pin holder. A hydraulic delay means contained within the interior bore of the device is actuable by a pressure change within the interior bore of the well pipe string to move the firing pin holder out of locking engagement with the firing pin, to release firing pin, after a predetermined time interval.

The hydraulic delay means preferably includes a fluid piston located within a fluid chamber and a means for evacuating the chamber. The evacuating means includes an orifice in the fluid chamber and a movable plug for the orifice. Upon actuation by a pressure change within the sub interior bore, the evacuating means drains the fluid chamber in a controlled fashion, thereby allowing the fluid piston to move within the chamber. The fluid piston is also connected to the firing pin holder, so that movement of the piston within the fluid chamber serves to move the firing pin holder out of locking engagement with the firing pin to release the firing pin after a predetermined time interval.

Additional objects, features and advantages will be apparent in the written description which follows.

DETAILED DESCRIPTION OF THE INVENTION

Figure 1A:
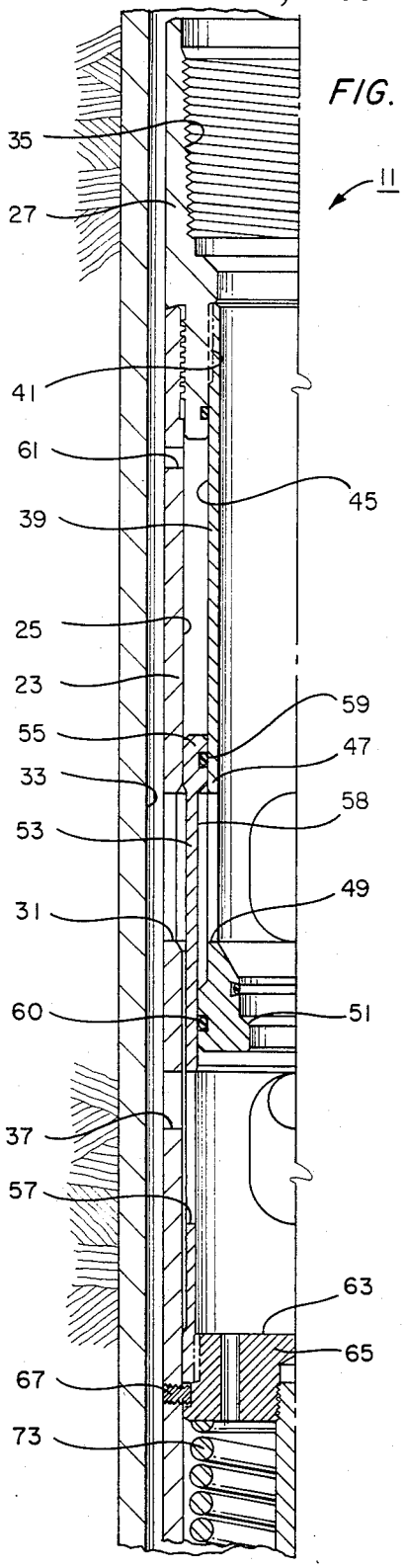
FIG. 1*a* is a quarter-sectional view of the upper portion of the firing head of the invention in the running-in position.
Figure 1B:
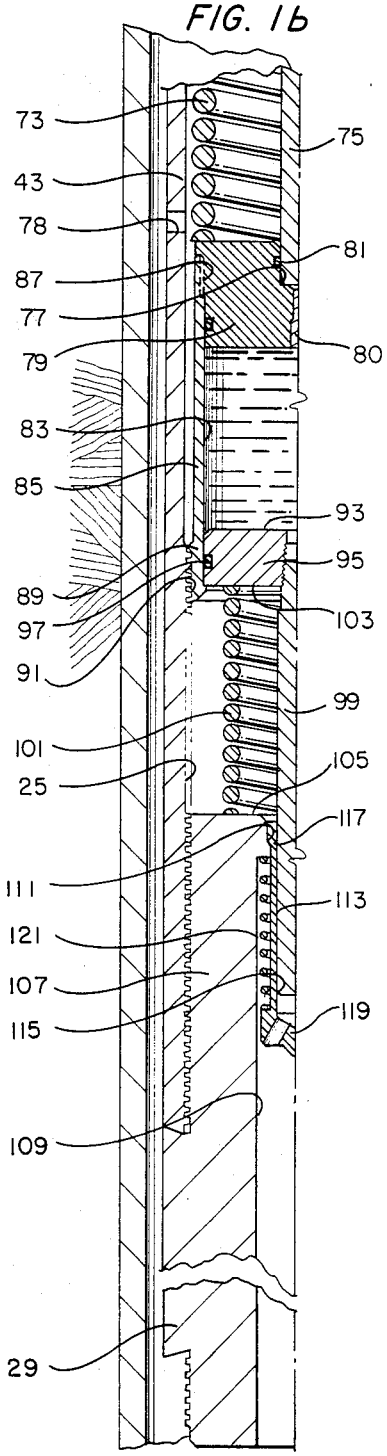
FIG. 1*b* is a downward continuation of the firing head of FIG. 1*a*.
Figure 4:
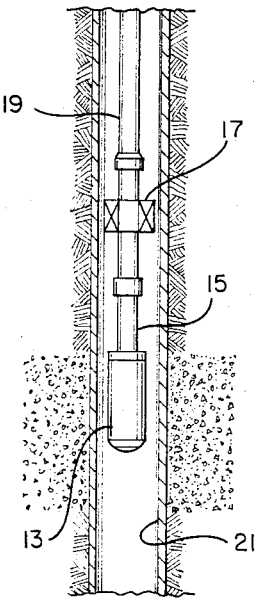
FIG. 4 is a schematic view of the apparatus of the invention being run into position within a well bore on a well tubing string.

Turning to FIGS. 1*a*–1*b*, there is shown a tubing pressurized firing apparatus of the invention designated generally as 11. The tubing pressurized firing apparatus is adapted to be used with a tubing conveyed perforating gun of the type known in the art which is used to perforate a cased well bore. FIG. 4 shows a simplified, schematic view of a typical perforating system which includes a perforating gun 13 which is coupled to a firing head 15, both of which are run below a well packer 17 which is carried on a well tubing string 19 extending to the surface.

Figure 5:
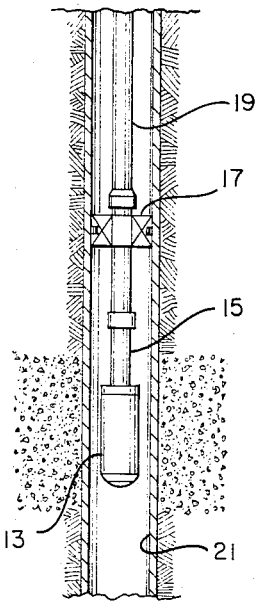
FIG. 5 is a schematic view similar to FIG. 4, showing a well packer on the well tubing string which has been actuated to seal off the well bore.
Figure 6:
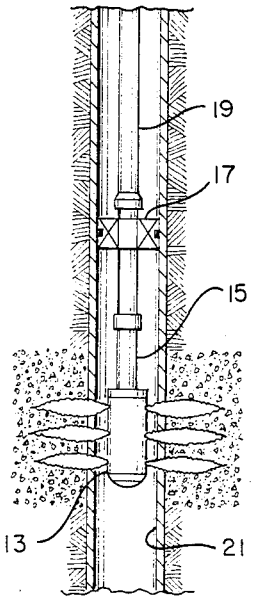
FIG. 6 is a schematic view of the apparatus showing the firing of the perforating gun.

As shown in FIGS. 4–6, the tubing conveyed perforating gun 13 is run into position, the packer 17 is set to seal off the well bore 21, and the surface well head equipment (not shown) is installed. Packer setting can be checked by circulating fluid under pressure through the well annulus or through the well tubing string. Once the top side work is completed and tested for safety, the perforating gun can be fired (FIG. 6) to bring in the well.

The firing head of the invention, as shown in FIG. 1*a* includes a tubular sub 23 having an interior bore 25, oppositely disposed connecting ends 27, 29, and at least one production port 31 for communicating the interior bore 25 with the surrounding well annulus 33. The connecting end 27 has an internally threaded surface 35 for connection in the well tubing string 19 (FIG. 4) passing to the well surface. One or more circulation ports 37 are also present in the tubular sub for initially circulating fluid from within the tubing string to the well annulus.

As shown in FIG. 1*a*, the tubing sub 23 also contains an inner mandrel 39 which threadedly engages the connecting end 27 at a threaded surface 41. The inner mandrel 39 is spaced apart from the interior bore 25 of the sub body 43, thereby defining an annular recess between the sidewall 45 and the interior bore 25.

The lower extent 47 of the inner mandrel 39 is provided with one or more openings 49, and the mandrel 39 terminates in an internal shoulder region 51. The shoulder region 51, of reduced internal diameter, serves as a ball catching sub for a ball dropped down the tubing string during the firing operation.

A sliding sleeve 53 is located within the interior of the tubular sub 23 and has an upper extent 55 adapted to slide upwardly within the annular recess between the bore 25 and sidewall 45. One or more openings 57 are provided in the sidewalls of the sliding sleeve 53 for alignment with the production ports 31 and with the inner mandrel openings 49. The sliding sleeve 53 has an internal O-ring 59, whereby the upper extent 55 presents a seal area which is responsive to pressure changes within the sub interior to move the sleeve opening 57 into alignment with the production port 31 and with the mandrel opening 49, as will be explained. The annular area between the bore 25 and sidewall 45 is initially evacuated and communicates with the well annulus by means of one or more ports 61.

Figure 3:
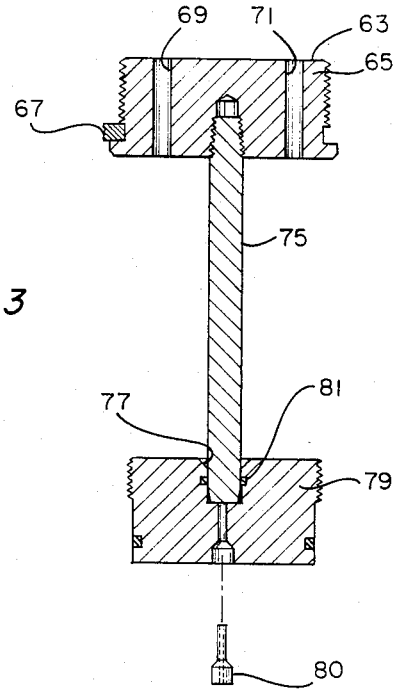
FIG. 3 is an isolated, cross-sectional view of the movable plug and orifice of the evacuating means of the invention.

The sliding sleeve 53 is initially restrained at the lower end thereof by threaded engagement with a movable plug 63. Plug 63 includes a circular head 65 which is connected to the sub body 43 by one or more shear pins 67. As shown in FIG. 3, the circular head 65 is provided with a plurality of passages 69, 71 which communicate the area below the circular head 65 with the area above the head. The circular head 65 is biased upwardly by means of a coiled spring 73 and has a centrally located, downwardly projecting plug element 75.

The plug element 75 is initially received within an orifice 77 provided in the central region of a circular, seal member 79. An O-ring seal 81 closes the orifice 77 when the plug element 75 is in the position shown in FIG. 1*b*. Preferably the orifice 77 is fitted with an orifice jet 80 which is used to regulate the flow of fluid through the orifice 77, as will be explained. The jet 80 can be a "jeweled orifice" jet, such as are used in acetylene torches and the like. Jeweled orifice jets are commercially available from the Lee Company, Westbrook, Conn. Such orifice jets can be ordered with precisely machined flow passages of known sizes. By appropriately selecting the flow passage size, the rate of flow of fluid through the orifice 77 can be determined.

The seal member 79 has a cylindrical bore 83 formed by a sleeve member 85 which is connected at an upper extent 87 to the seal member 79, and at a lower extent 89 to a threaded surface 91 of the sub body 43. The cylindrical bore 83, along with fluid piston 93 (FIG. 1*b*), form a fluid chamber within the sub interior bore. Fluid piston 93 has a solid, piston portion 95 having an outer, O-ring seal 97 for slidingly engaging the cylindrical bore 83 of the fluid chamber. Fluid piston 93 also includes a centrally located, cylindrical firing pin holder 99. The fluid piston 93 is biased upwardly by means of a coil spring 101 which acts between a lower surface 103 of the piston portion 95 and an internal shoulder 105 formed within the interior bore 25 of the sub body 43 by end portion 107 of the tubular sub 23.

As shown in FIG. 1*b*, the end portion 107 of the apparatus has a cylindrical bore 109 having a collet receiving recess 111 formed at an upper extent thereof.

A firing pin 113 is contained within the bore 109 and initially restrained in a cocked position by the firing pin holder 99. As shown in FIG. 1*b*, the firing pin 113 is a collet shaped member having a cylindrical interior 115, and having collet fingers 117 at one extent thereof which are initially restrained within the collet recess 111. The firing pin 113 also has a striking end 119 at an opposite extent, which is adapted to strike a percussion member to actuate an explosive charge.

The percussion detonator, or firing cap, and explosive charge are not illustrated, since such devices are well known in the art. The reader is referred to, for example, U.S. Pat. Nos. 3,800,705; 3,189,094; and 2,876,701, the disclosure of which is hereby incorporated by reference, and which all illustrate percussion detonating mechanisms.

The operation of the invention will now be described. As shown in FIG. 4, the perforating gun 13 and firing head 15 are run to the proper depth in a well bore which is lined by a casing. As shown in FIG. 1*a*, well fluids can pass through the ports 37 into the tubing interior to fill the tubing. Once the desired depth is reached, fluid is circulated downwardly through the tubing string and out through the ports 37 into the well bore to provide the desired hydrostatic head within the well. The well head installation at the surface can then be completed and tested for safety.

FIGS. 1*a* and 1*b* show the firing head of the invention in the running-in position. The sliding sleeve 53 is pinned in the position shown by shear pins 67 and the production ports 31 are closed off by the sliding sleeve and O-ring seals 59, 60. As shown in FIG. 1*b*, the bore 83 of the fluid chamber is filled with hydraulic fluid so that the fluid piston is held in the position shown, with the firing pin holder 99 underlying the collet fingers 117 of the firing pin 113. The hydraulic fluid is contained within the fluid chamber 83 due to the presence of the plug element 75 within the orifice 77.

Figure 2A:
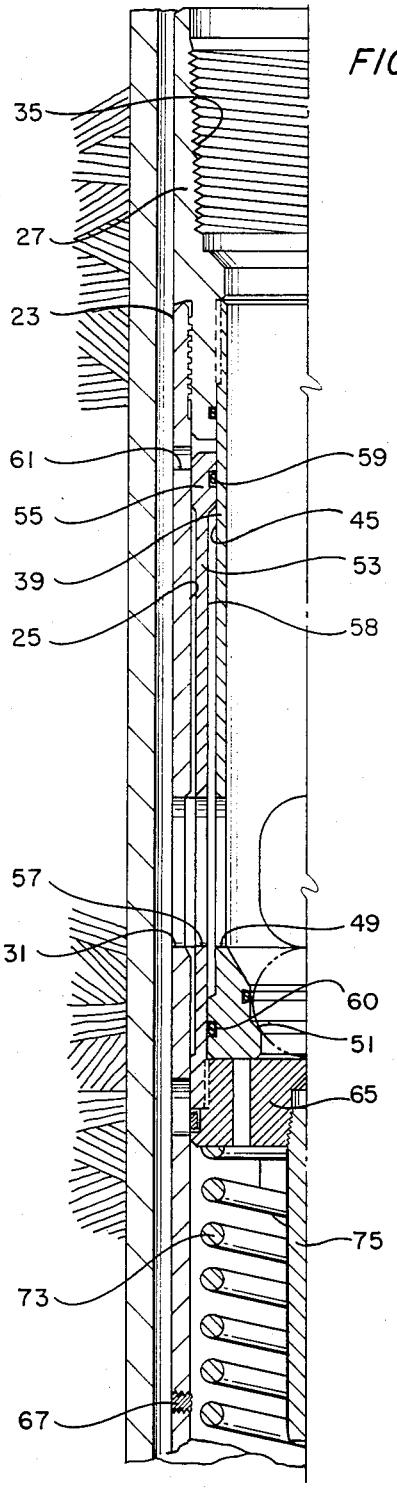
FIG. 2*a* is a quarter-sectional view of the firing head similar to FIG. 1*a* after pressuring the interior of the tubing string.

A ball is then dropped through the tubing string to seat in the shoulder region 51 of the inner mandrel 39 (shown in dotted lines in FIG. 2*a*). This serves to block off communication with the well annulus through the ports 37 and the tubing string can then be pressured up from the surface. Pressuring the tubing string to a first predetermined level, sets the well packer (17 in FIG. 5), and fluid can be circulated down the well annulus to check the packer set. Pressure inside the tubing string is then raised to a second, predetermined level, higher than the first level. Because the internal diameter of the sliding sleeve 53 in the region 58 is larger than the internal diameter presented at the O-ring seal 59, pressuring up the tubing string causes the sliding sleeve 53 to move upwardly from the position shown in FIG. 1*a* to the position shown in FIG. 2*a*.

Shear pins 67 are sheared at a predetermined pressure level, allowing the sliding sleeve 53 to move upwardly to the position shown in FIG. 2*a*, and thereby aligning the sleeve openings 57 with the production ports 31 and with openings 49. There is thus established immediate fluid communication between the tubing interior and the well annulus, allowing the tubing pressure to equalize with pressure of fluid within the well annulus. Pressure can be relieved at the well surface using well head equipment, if necessary.

Figure 2B:
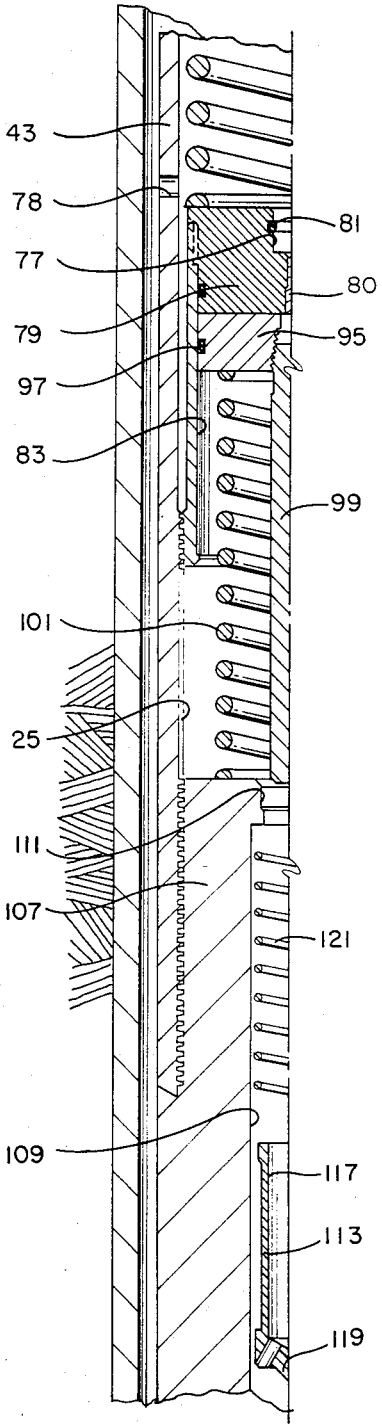
FIG. 2*b* is a downward continuation of the firing head of FIG. 2*a*.

Movement of the sliding sleeve 53 upward causes the movable plug 63 and plug element 75 to be drawn upwardly from the position shown in FIG. 1*b* to the position shown in FIG. 2*b*. As the plug element 75 is drawn upwardly, the orifice (77 in FIG. 1*b* and FIG. 3) is opened, thereby allowing hydraulic fluid in the fluid chamber to drain from the chamber through the orifice jet 80 and orifice 77. Drain ports 78 in the sub body 43 provide a path for evacuating the fluid chamber. As the fluid chamber is evacuated, coiled spring 101 biases the fluid piston 93 upwardly within the fluid chamber. Upward movement of the fluid piston 93 causes the associated firing pin holder 99 to be pulled from beneath the collet fingers 117 of the firing pin 113. As the fluid piston 93 travels to the position shown in FIG. 2*b*, the firing pin is released from the collet receiving recess 111 and coil spring 121 propels the firing pin downwardly so that the striking end 119 of the firing pin can strike the percussion detonator to fire the gun 13 (FIG. 6).

An invention has been provided with several advantages. The elimination of a dropped bar to fire the tubing conveyed perforating gun provides safety advantages, since dropped bars can hang in the tubing string and later fire at any time when the tubing is being retrieved. Annulus pressure operated firing mechanisms can become clogged and present a possible leak path between the tubing interior and the well annulus. Wireline actuated systems can be dangerous due to the presence of an under balanced pressure condition in the well. Because the firing head is operated by tubing pressure from the well surface, the tubing can be safely pulled from the well bore without fear of firing the perforating gun. The hydromechanical delay mechanism provided by the fluid cylinder and piston of the firing head provide a controlled delay period between the pressurization step and the firing step. This timed delay, during which the production ports 31 and 49 are opened, allows the tubing pressure to be equalized in the well bore, immediately prior to firing the gun.

While the invention has been shown in only one of its forms, it is not thus limited but is susceptible to various changes and modifications without departing from the spirit thereof.

I claim:

1. A firing head for a tubing conveyed perforating gun of the type which uses a firing pin to strike an explosive charge to perforate a well bore for production of well bore fluids, comprising:

a tubular sub having an interior bore and oppositely disposed connecting ends for connection in a well pipe string;

a firing pin contained within said interior bore and initially restrained in a cocked position by a firing pin holder;

biasing means for propelling said firing pin toward said explosive charge upon the release of said firing pin holder; and hydraulic delay means contained within said interior bore and actuable by a pressure change within said sub interior bore from the well surface to move said firing pin holder out of locking engagement with said firing pin to release said firing pin after a predetermined time interval, and wherein said hydraulic delay means includes a fluid piston located within a fluid chamber and a means for evacuating said chamber.

2. The firing head of claim 1, wherein said evacuating means includes an orifice fitted with an orifice jet in said fluid chamber and a movable plug for said orifice, said evacuating means being operable to move said plug from said orifice to drain said chamber in controlled fashion.

3. The firing head of claim 2, wherein said fluid piston is connected to said firing pin holder so that movement of said piston within said fluid chamber serves to move said firing pin holder out of locking engagement with said firing pin in a predetermined time interval.

4. The firing head of claim 1, wherein said firing pin is a collet shaped member having a cylindrical interior, said firing pin having collet fingers at one extent thereof which are initially restrained within a collet recess in said sub interior and having a striking end at an opposite extent, and wherein said firing pin holder is a cylindrical member which is received within said collet member interior to underlie said collet fingers in said restrained position.

5. A firing head for a tubing conveyed perforating gun of the type which uses a firing pin to strike an explosive charge to perforate a well bore for production of well bore fluids, comprising:

a tubular sub having an interior bore, oppositely disposed connecting ends for connection in a well pipe string, and at least one production port for communicating the interior bore with the surrounding well annulus;

a sliding sleeve located within the interior of the tubular sub, said sleeve having at least one opening in a sidewall thereof for alignment with said production port, and said sleeve having a seal area responsive to pressure changes within said sub interior to move said sleeve opening into alignment with said production port;

a firing pin contained within said interior bore and initially restrained in a cocked position by a firing pin holder;

biasing means for propelling said firing pin toward said explosive charge upon the release of said firing pin holder;

a fluid piston located within a fluid chamber in said sub interior bore, said fluid piston being movable within said fluid chamber upon evacuation of said chamber and said fluid piston being operably connected to said firing pin holder for releasing said holder upon movement of said piston; and evacuation means associated with said sliding sleeve and actuable by a change in pressure within said sub interior bore to evacuate said fluid cylinder.

6. The firing head of claim 5, wherein said evacuating means includes an orifice in said fluid chamber and a movable plug for said orifice, said evacuating means being operable to move said plug from said orifice to drain said chamber in controlled fashion.

7. The firing head of claim 6, wherein said movable plug is connected to said sliding sleeve whereby pressure acting upon said sleeve seal area moves said sleeve and, in turn, said movable plug to align said sleeve opening with said production port and move said firing pin holder out of locking engagement with said firing pin.

8. The firing pin of claim 7, wherein said firing pin is a collet shaped member having a cylindrical interior, said firing pin having collet fingers at one extent thereof which are initially restrained within a collet recess in said sub interior and having a striking end at an opposite extent, and wherein said firing pin holder is a cylindrical member which is received within said collet member interior to underlie said collet fingers in said restrained position.

9. A method of perforating a well bore with a tubing conveyed perforating gun of the type which uses a firing pin to strike an explosive charge to perforate a well bore for production of well bore fluids, comprising the steps of:

providing a tubing pressurized firing apparatus between said tubing string and said perforating gun in said well tubing string, said firing apparatus including a pressure responsive actuator means responsive to changes in pressure within said tubing string from the well surface;

providing a hydraulic delay means as a part of said actuator means, said delay means being responsive to pressure changes within said tubing string from the well surface to actuate said firing pin and strike said explosive charge after a predetermined period of time;

running said firing apparatus to a selected depth within the well bore on said well tubing string;

dropping a ball through the tubing string from the surface to a ball seat provided as a part of the actuator means to thereby block off communication between the tubing string above the ball and the well annulus; and increasing the pressure within the tubing string by a predetermined amount to actuate said hydraulic delay means and detonate said charge after said predetermined period of time.

10. A method of perforating a well bore with a tubing conveyed perforating gun of the type which uses a firing pin to strike an explosive charge to perforate a well bore for production of well bore fluids, comprising the steps of:

providing a tubing pressurized firing apparatus between said tubing string and said perforating gun in said well tubing string, said firing apparatus including a pressure responsive actuator means responsive to changes in pressure within said tubing string from the well surface;

providing a fluid piston within a fluid chamber in said firing apparatus and connecting said fluid piston to a holder for said firing pin, whereby movement of said piston within said fluid chamber serves to move said firing pin holder and release said firing pin;

filling said fluid piston at the well surface so that the fluid in said chamber initially resists movement of said firing pin holder and restrains said firing pin; and draining said fluid chamber after said firing apparatus is run into position within said well bore by applying pressure through said tubing string to act upon an evacuating means associated with said fluid chamber, thereby actuating said hydraulic delay means and detonating said charge after a predetermined period of time.

11. The method of claim 10, wherein said fluid chamber is provided with an orifice of known diameter which is initially plugged and wherein said delay is achieved by draining fluid from said chamber, through said orifice, to evacuate said chamber in a known time interval.

12. The method of claim 11, further comprising the steps of:

providing said firing apparatus with at least one production port for communicating the interior of said tubing string with the well annulus;

providing a sliding sleeve as a part of said firing apparatus, said sliding sleeve having at least one opening in a sidewall thereof for alignment with said production port, and said sliding sleeve being provided with a seal area responsive to pressure changes within said sub interior to move said sleeve into alignment with said production port; and connecting said sliding sleeve to said orifice plug so that movement of said sleeve to align said opening and port coincides with the movement of said plug from said orifice to begin draining said fluid chamber, thereby communicating the well annulus with the interior of said tubing string prior to firing said explosive charge to perforate said well.

* * * * *